US007706726B2

(12) United States Patent
Van der Werf et al.

(10) Patent No.: US 7,706,726 B2
(45) Date of Patent: Apr. 27, 2010

(54) APPARATUS AND PROCESS TO RECLAIM TONER FROM A TONER/CARRIER MIXTURE

(75) Inventors: Johan M. Van der Werf, Overloon (NL); Robert Hans Buytendijk, Venray (NL); Peter J. A. Otten, Maasbracht (NL); Johannes S. T. M. Gubbels, Sambeek (NL); Theo Versteegen, Afferden (NL)

(73) Assignee: Xerox Corporation, Norwalk, CT (US)

( * ) Notice: Subject to any disclaimer, the term of this patent is extended or adjusted under 35 U.S.C. 154(b) by 804 days.

(21) Appl. No.: 11/638,345

(22) Filed: Dec. 13, 2006

(65) Prior Publication Data

US 2008/0145104 A1 Jun. 19, 2008

(51) Int. Cl.
*G03G 15/08* (2006.01)
*G03G 21/00* (2006.01)

(52) U.S. Cl. ..... 399/253; 399/358; 399/359; 399/120

(58) Field of Classification Search ..... 399/253, 399/358, 359, 120
See application file for complete search history.

(56) References Cited

U.S. PATENT DOCUMENTS

| | | | | |
|---|---|---|---|---|
| 4,159,786 | A * | 7/1979 | Biddle et al. | 222/64 |
| 5,521,690 | A * | 5/1996 | Taffler et al. | 399/93 |
| 5,697,018 | A * | 12/1997 | Thomas et al. | 399/93 |
| 5,888,691 | A | 3/1999 | Laing et al. | |
| 6,562,109 | B2 * | 5/2003 | Livingston et al. | 95/270 |
| 2004/0126141 | A1 * | 7/2004 | Mitchell et al. | 399/222 |

* cited by examiner

*Primary Examiner*—David M Gray
*Assistant Examiner*—Rodney Bonnette
(74) *Attorney, Agent, or Firm*—Pillsbury Winthrop Shaw Pittman LLP

(57) ABSTRACT

Methods of manufacturing toner for use in electrophotographic imaging members, such as photoreceptor structures. More particularly, embodiments pertain to an apparatus and process for separating toner from toner/carrier mixtures, such as reclaiming toner from waste toner, much more efficiently and with improved yields.

26 Claims, 4 Drawing Sheets

APPARATUS AND PROCESS TO RECLAIM TONER FROM A TONER/CARRIER MIXTURE

BACKGROUND

Herein disclosed are embodiments pertaining to an apparatus and process for separating toner from a toner/carrier mixture, such as for example, waste toner containing carrier. The apparatus and process described herein operate much more efficiently to separate low density particles from larger, high density particles.

Reclaiming toner from electrophotographic machines is a highly desirable alternative to depositing toner in landfills or subjecting toner to incineration. Reclaim of field returned waste toner through addition into an extruder is a known process for some existing toners. A conventional manner of producing such toner is disclosed in Laing et al., U.S. Pat. No. 5,888,691, which is herein all incorporated by reference.

A problem that limits the efficiency of the reclaiming process, however, is that modern xerographic devices applies replenisher (toner plus some 5% to 40% fresh carrier) rather than only toner. Replenishers are used in order to keep the developer (carrier with up to 5% toner) in a steady-state aging condition. The equivalent amount of added fresh carrier leaves the developer through an overflow system and for some of these devices both waste toner and waste carrier are collected in the same waste bottle.

For example, some waste toners are estimated to include about 40% to 50% carrier by weight of the total waste toner weight. At such high carrier to toner ratios, the conventional carrier separation process through direct turboscreening, for example, screening over 44 microns, is no longer feasible as frequent screen blinding will occur. In blinding, the screen apertures may become clogged or covered by the heavier and larger carrier particles and thus become inefficient in operation or cease to operate properly altogether. As a result, such waste toners is not available for reclaim into regular toner processing.

Thus, there is a need for a more efficient separation process, and apparatus for performing such, to separate low density particles from a mixture of high and low density particles, including an apparatus and process for efficiently reclaiming waste toners, including those that have a high carrier content, to allow reclaim through regular toner processing.

SUMMARY

According to embodiments illustrated herein, there is provided a way to separate a mixture of high and low density particles which can also be used to remove carrier particles from waste toner.

In particular, an embodiment provides a process for separating toner from a toner/carrier mixture, comprising collecting waste toner containing a carrier, separating the carrier from the waste toner with a separating apparatus, the separating apparatus further comprising a cyclone separator covering a receiving vessel, a pressurized ring attached to the cyclone separator, an annular plenum defined by a tunnel, the tunnel being formed along an inner circumference of the pressurized ring, and a slit formed along an outer circumference of the tunnel, wherein pressurized air from the pressurized ring blows into the annular plenum through the slit to further separate the waste toner from the carrier such that the waste toner continues on a flow path along an inner circumferential of the annular plenum and the carrier continues along an outer circumferential of the annular plenum to exit into the receiving vessel, screening the waste toner in a screening device attached to the separating apparatus to remove extraneous debris to produce screened waste toner, and extruding the screened waste toner by itself and optionally with further raw materials in an extruder apparatus to produce a melt mixed product.

Embodiments also provide an apparatus for separating toner from a toner/carrier mixture, comprising a cyclone separator covering a receiving vessel, a pressurized ring attached to an inside of the cover, an annular plenum defined by a tunnel, the tunnel being formed along an inner circumference of the pressurized ring, and a slit formed along an outer circumference of the tunnel, wherein pressurized air from the pressurized ring blows into the annular plenum through the slit to further separate a toner from a toner/carrier mixture such that the toner continues on a flow path along an inner circumferential of the annular plenum and the carrier continues along an outer circumferential of the annular plenum to exit into the receiving vessel.

Further embodiments provide an apparatus for separating toner from a toner/carrier mixture, comprising a cyclone separator covering a receiving vessel, a pressurized ring attached to an inside of the cover, an annular plenum defined by a tunnel, the tunnel being formed along an inner circumference of the pressurized ring, and a slit formed along an outer circumference of the tunnel, the slit having a width of from about 0.1 mm to about 0.3 mm, wherein the cover further includes an entryway and an exitway and the exitway is in flow communication with a screening device adapted to screen toner, and wherein pressurized air from the pressurized ring blows into the annular plenum through the slit to further separate a toner from a toner/carrier mixture such that the toner continues on a flow path along an inner circumferential of the annular plenum and the carrier continues along an outer circumferential of the annular plenum to exit into the receiving vessel.

BRIEF DESCRIPTION OF THE DRAWINGS

For a better understanding of the present invention, reference may be had to the accompanying figures.

DETAILED DESCRIPTION

In the following description, it is understood that other embodiments may be utilized and structural and operational changes may be made without departure from the scope of the present embodiments disclosed herein.

The present embodiments relate to an apparatus and process for separating low density particles from larger, high density particles in a mixture of both low and high density particles. In embodiments, the apparatus and process is used to separate toner from a toner/carrier mixture, such as for example, waste toner containing carrier. The embodiments provide a much more efficient manner of reclaiming toner from such waste toner.

Waste toner often comprises of a toner/carrier mixture which needs to be separated as the carrier will interfere with later processes to reclaim the waste toner for re-use. After subjecting the waste toner to the present embodiments as described herein, the waste toner contains very little or no carrier.

According to the embodiments, the operating set points of a cyclone separator are tuned to separate toner from a toner/carrier mixture, such as for example, waste toner from carrier, rather than toner fines from toner, such that waste toner subjected to the centrifugal forces is separated from any carrier that is also contained in the waste toner. This step prevents screen blinding when the separated waste toner is subsequently sent into a turboscreener for screening. The reclaimed toner can then be used in extrusions of new toner. Without the use of the cyclone separator, the carrier will block the screening apertures and render the toner reclaim process very inefficient.

Figure 1:
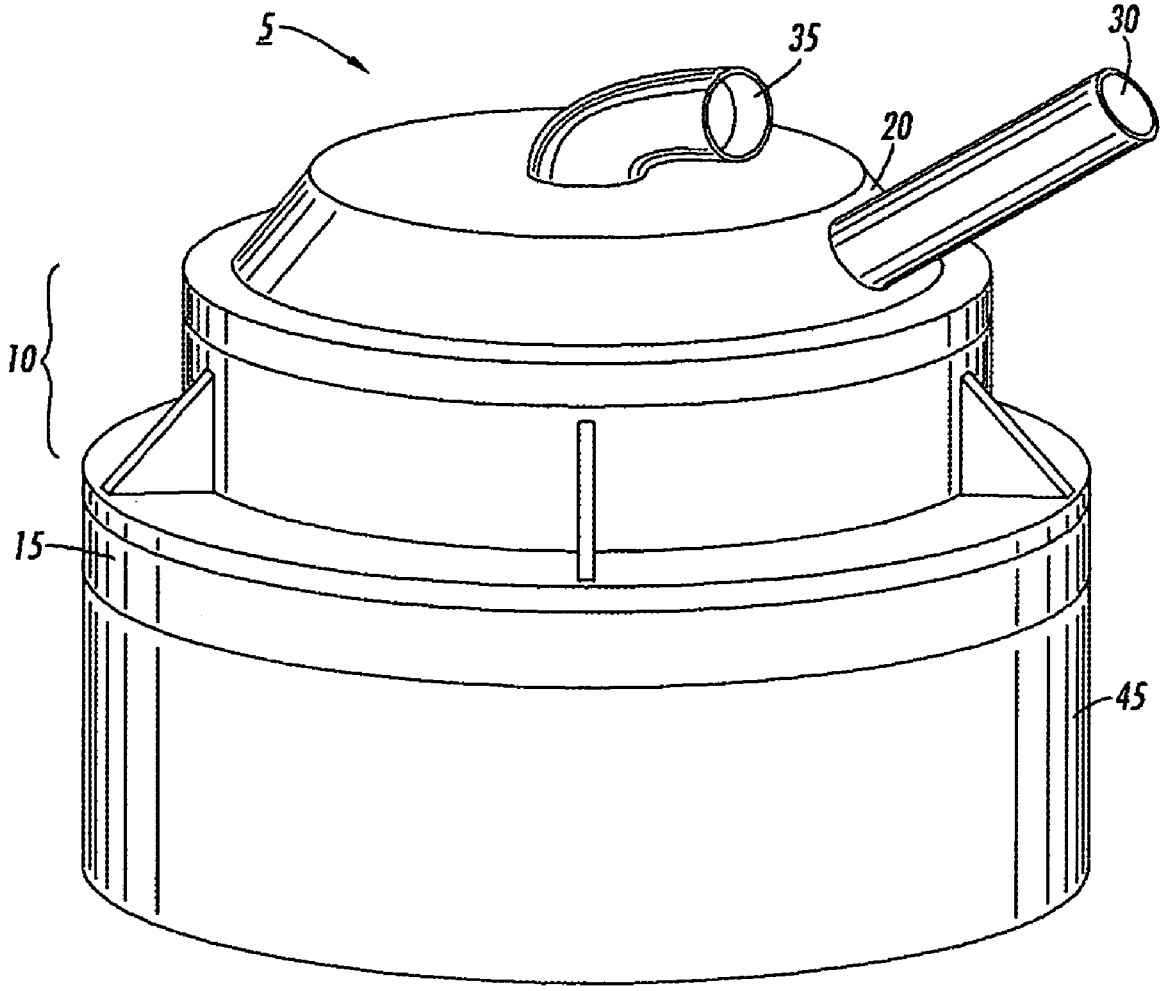
FIG. 1 is a perspective view of a separating apparatus according to an embodiment of the present disclosure.
Figure 2:
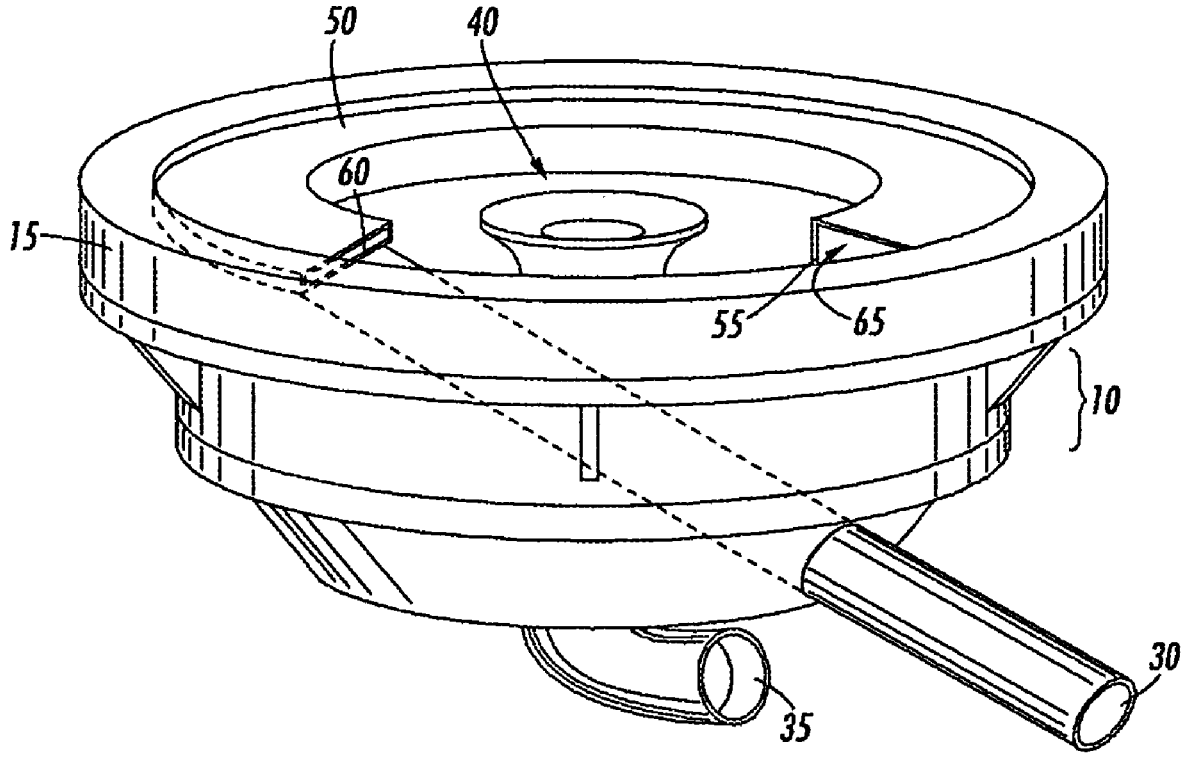
FIG. 2 is a perspective view of an underside of a separating apparatus according to another embodiment of the present disclosure.
Figure 3:
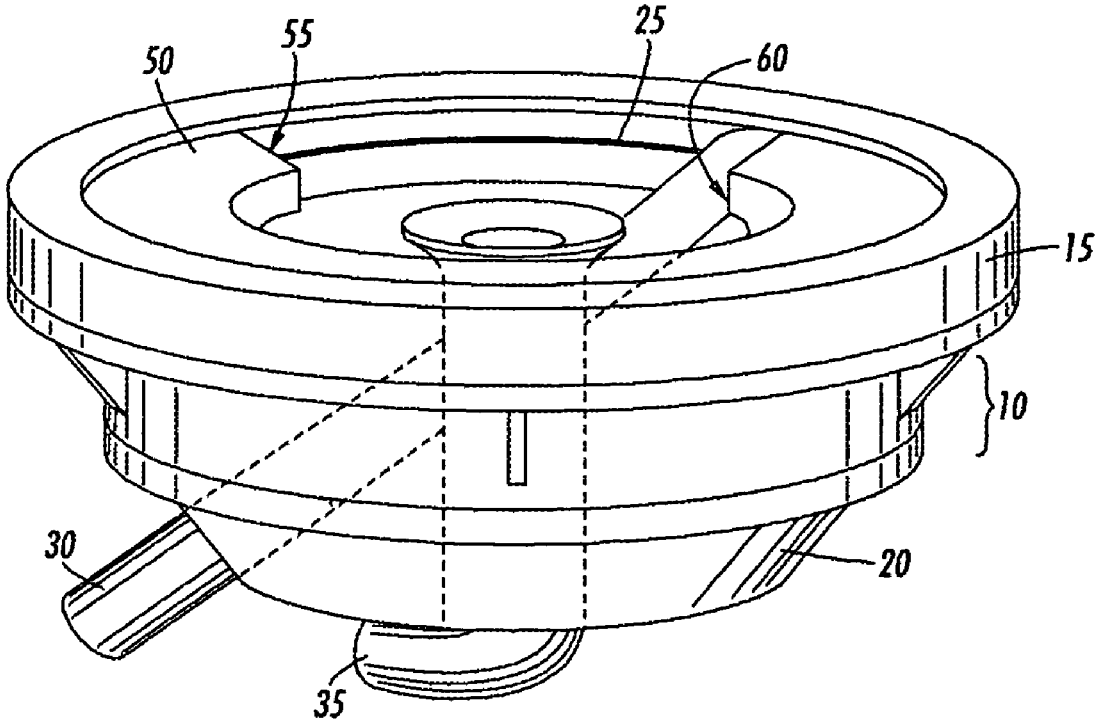
FIG. 3 is an alternative view of FIG. 2 according to an embodiment of the present disclosure.

In embodiments, there is provided an apparatus for separating toner from a toner/carrier mixture. As shown in FIG. 1, the separating apparatus 5 comprises a cyclone separator 10 being a cover for a receiving vessel or container 45. A pressurized ring 15 may be welded to the outside of the lower part of cyclone 15 and forms part of the cover 20. The pressurized ring 15 may apply an overpressure of from about 0.15 to about 0.25 bar. In FIG. 2, the cyclone separator is shown upside down for a clearer view. It can be seen that a tunnel 50, located inside the cover 20, is formed along an inner circumference of the ring 15. The tunnel 50 defines an annular plenum 65 and, as shown in FIG. 3, has a slit 25 formed along the outer circumference of the tunnel 50. FIG. 3 is view of FIG. 2, rotated over 180° so that the inner wall of the pressurized ring 15 between the tunnel entrance 60 and tunnel exit 55 can be seen. The slit 25 provides an opening between the pressurized ring 15 and the tunnel 50, thereby allowing airflow through the slit 25 from the pressurized ring 15 into the tunnel 50 at a perpendicular to the main airflow flowing through the tunnel 50. The tunnel entrance 55 is connected to the cyclone entryway 30, in the cover 20, while exit 60 ends in the cyclone chamber. The cover 20 includes the entryway 30 and an exitway 35 where the exitway 35 is in flow communication with a screening device, such as a turboscreener, adapted to screen waste toner comprising a toner/carrier mixture.

A toner/carrier mixture, such as for example, waste toner having carrier, is delivered into the separating apparatus 5 through the entryway 30 of the cover 20 and into the tunnel 50 (being a part of the cyclone). The toner/carrier mixture is subjected to centrifugal forces in the tunnel 50 which pushes the mass of the mixture to the outer part or outside of the tunnel 50. The "outside" of the tunnel being defined as the portion of the tunnel being away from the center 40 of the cyclone separator 10, and the "inside" of the tunnel being defined as the portion of the tunnel being closer to the center 40 of the cyclone separator 10. Pressurized air from the pressurized ring 15 enters the tunnel 50 through the slit 25, at a perpendicular direction to the main airflow traveling through the annular plenum. 65, blowing toner off of the carrier particles. This "blow-off" airflow separates the toner from the carrier.

While the heavier carrier particles remain at the outside of the tunnel 50 the lighter toner particles are blown toward the inner part or inside of the tunnel 50. The mass leaving the tunnel exit 55 toward the outside of the tunnel 50 will be mostly carrier falling into the container 45, such as for example, a barrel, below and connected to the cyclone cover 20. The mass leaving the tunnel exit 55 toward the inside of the tunnel 50 will be mostly toner being carried by the main airflow which leaves the cyclone cover 20 through the exit 35 and continues into the screening device. Thus, the ring 15 acts as a carrier separation unit wherein the waste toner is circulated along the annular plenum 65 and the force of the pressurized air separates the toner from the carrier.

In embodiments, the toner/carrier mixture has a toner to carrier ratio of from about 15:1 to about 1:2. These embodiments may be used to generally separate light density particles form high density particles, such as separating toner from waste toner containing carrier or toner from replenisher.

The slit 25 may have a width of from about 0.1 mm to about 0.3 mm, or from about 0.2 mm to about 0.25 mm. In a particular embodiment, the slit 25 has a width of from about 0.1 mm to about 0.3 mm. In a particular embodiment, the slit is about 25 mm in width, and the pressure applied by the pressurized ring 15 is from about 0.15 to about 0.25 bar.

Generally, a narrow slit is used to create a high speed blow-off airflow, which is more efficient in separating the particles than a wide slit with low speed blow-off air. The width of the slit and the overpressure from the pressurized ring is selected based on consideration of the size of cyclone cover and main airflow through the cyclone cover. The present embodiments create a high speed blow-off airflow that ensures substantially no toner will remain trapped in the carrier mass, but does not use such high overpressure that would create a speed that would blow both carrier and toner towards the inside of the tunnel and result in a high amount of carrier being moved with toner to the turboscreener.

Figure 4:
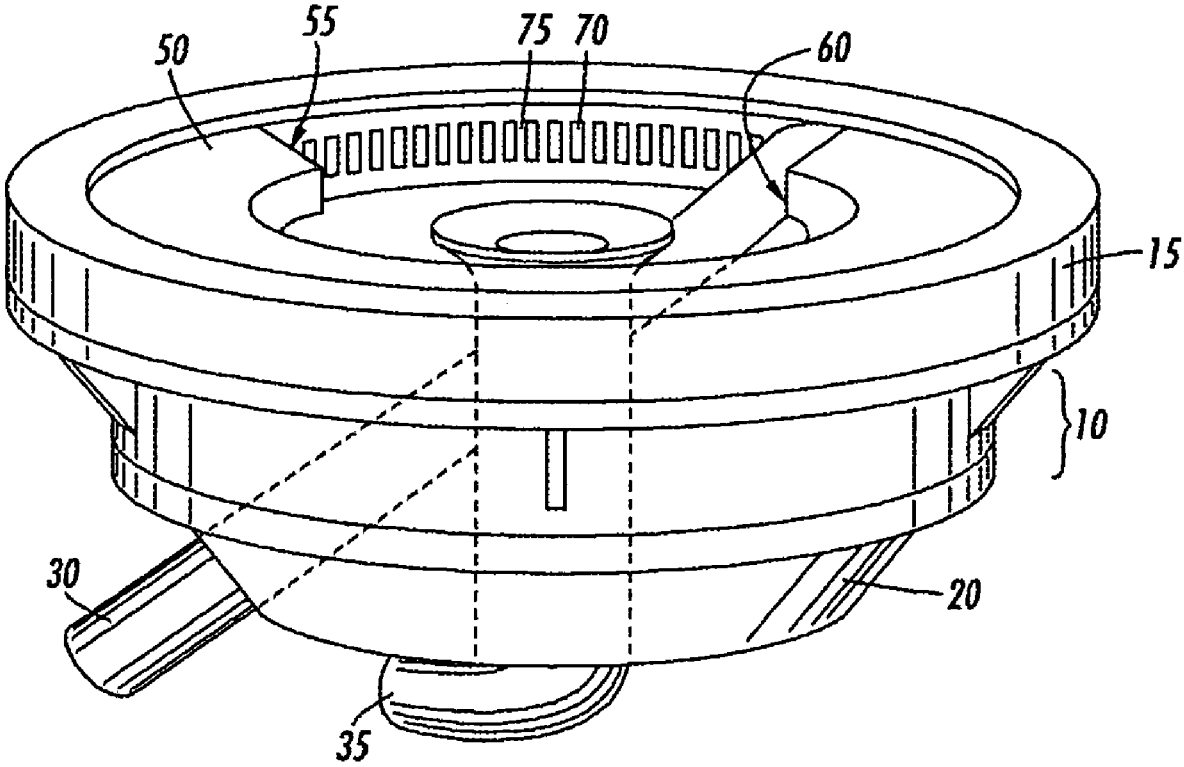
FIG. 4 is an alternative perspective view of a separating apparatus according to an embodiment of the present disclosure.

In further embodiments, shown in FIG. 4, the slit 25 further comprises a plurality of vertical slits 70 which may form a grating 75 over the entire circumferential of the pressurized ring. In the embodiment, the vertical slits 70 assure blow-off air to be present over the entire tunnel height. In embodiments, the slits 70 might be constructed such to have the pressurized air or blow-off airflow blown through the slits at a counter current direction to the flow path in the annular plenum. In other embodiments, the slits 70 might be constructed such to have the pressurized air or blow-off airflow blown through the slits 70 along the current direction of the flow path in the annular plenum.

The waste toner may be passed through the tunnel 50 several times to ensure the optimal level of separation. In embodiments, the waste toner is passed through the tunnel from about 1 to about 5 times. Depending on the number of times the waste toner is passed through the apparatus 5, up to about 100% toner can be reclaimed from the waste toner. In specific embodiments, from about 50% to about 70% toner is reclaimed from the waste toner.

In yet other embodiments, there is provided a process for separating toner from a toner/carrier mixture. The waste toner may have a toner to carrier ratio of from about 15:1 to about 1:2. The process comprises collecting waste toner containing a carrier and subjecting the toner/carrier mixture to a separating step. In particular embodiments, this process can be used to effectively reclaim toner from any toner/carrier mixture. In embodiments, the carrier is separated from the waste toner comprising the carrier with a separating apparatus comprising a cyclone separator with a pressurized ring attached therewith. The pressurized ring has a tunnel formed along the inner circumference of the ring and the tunnel defines an annular plenum. The tunnel and the defined annular plenum, in embodiments, is formed over 270 degrees of the cyclone separator. In further embodiments, the tunnel length may be extended spiral-wise over several cyclone revolutions. The tunnel concentrates the full airflow over the entire length of the annular plenum before being able to escape into the return vortex. It appears that better separation is achieved from a longer annular plenum length and by spiraling the ring would allow the annular plenum to extend over several revolutions.

A slit is formed along an entire outer circumference of the tunnel. As described above, the larger and heavier carrier particles continue to travel through the outside of the tunnel and is subsequently collected into a container below the cyclone cover. The separating step can be repeated to ensure that the separated waste toner contains no or very little carrier, for example, from about 1 to about 5 times. Once the toner and carrier is satisfactorily separated, the separated waste toner is subjected to screening to remove extraneous debris. The screening may be performed by a screening device, such as a turboscreener. The screened waste toner may be put into an extruder apparatus by itself or with other raw materials to produce a melt mixed product. In further embodiments, the process may also including grinding and classifying the melt mixed product produced providing re-manufactured toner particles.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLE

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example I

A modified cyclone separator cover was used fitting a 200 liter steel barrel. In the cyclone separator cover, an air-pressurized ring (0.25 bar) was installed. The ring had a 0.2 mm slit along the entire inner circumference of the ring. Next to the ring, over 270 degrees, a tunnel was mounted inside the cover and connected to the entryway to the cover. The cyclone separator was placed on a 200 liter steel barrel. The cyclone separator was connected to the toner feed line upfront of a Turboscreener (available from Sweco, Florence, Ky.). Airflow created by the downstream blower from the Turboscreener picked up the toner/carrier mixture at the feed rotary valve and sucked the mixture with the air through the cyclone separator cover where airflow from the pressurized ring entered into the annular plenum through the slit at a direction perpendicular to the main airflow in the tunnel (generated by the downstream turboscreener blower). The main airflow generated by the downstream blower was generated in an order of about 450 $m^3$/hr (or about 25 m/sec) in comparison to what was generated by the pressurized airflow from the 0.2 mm slit at from about 0.1 to about 0.3 bar overpressure in the pressurized ring.

The toner was blown-off from the carrier mass towards the inside of the tunnel. The carrier continued traveling along the outer side of the tunnel. Subsequently, the heavy carrier fell into the steel barrel while exiting from the outer side of the tunnel and the lighter toner particles continued with the main airflow and exited from the inside of the tunnel into the Turboscreener.

Results

The results of the separation testing demonstrated that about 70% of the available toner was reclaimed from the waste toner by the Turboscreener after being subjected to two passes through the cyclone separator.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process for separating toner from a toner/carrier mixture, comprising:

(a) collecting waste toner containing a carrier;

(b) separating the carrier from the waste toner with a separating apparatus, the separating apparatus further comprising a cyclone separator covering a receiving vessel, a pressurized ring attached to the cyclone separator, an annular plenum defined by a tunnel, the tunnel being formed along an inner circumference of the pressurized ring, and a slit formed along an outer circumference of the tunnel, wherein pressurized air from the pressurized ring blows into the annular plenum through the slit to further separate the waste toner from the carrier such that the waste toner continues on a flow path along an inner circumferential of the annular plenum and the carrier continues along an outer circumferential of the annular plenum to exit into the receiving vessel;

(c) screening the waste toner in a screening device attached to the separating apparatus to remove extraneous debris to produce screened waste toner; and (d) extruding the screened waste toner by itself and optionally with further raw materials in an extruder apparatus to produce a melt mixed product.

2. The process of claim 1 further including grinding and classifying the melt mixed product to provide re-manufactured toner particles.

3. The process of claim 1, wherein the waste toner has a toner to carrier ratio of from about 15:1 to about 1:2.

4. The process of claim 1, wherein the waste toner is subjected to (b) at least from about 1 to about 5 times.

5. The process of claim 1, wherein the waste toner continues on the flow path along the annular plenum and exits the tunnel directly into the screening device.

6. The process of claim 1, wherein the slit runs in a horizontal direction and has a width of from about 0.1 mm to about 0.3 mm.

7. The process of claim 6, wherein the slit has a width of from about 0.2 mm to about 0.25 mm.

8. The process of claim 1, wherein the pressurized air blows through the slit at a perpendicular direction to the flow path in the annular plenum.

9. The process of claim 1, wherein the slit further comprises a plurality of vertical slits forming a grating over an entire circumference of the pressurized ring.

10. The process of claim 9, wherein the pressurized air blows through the slit at a counter current direction to the flow path in the annular plenum.

11. The process of claim 9, wherein the pressurized air blows through the slit along a current direction of the flow path in the annular plenum.

12. The process of claim 1, wherein the pressurized ring has a pressure of from about 0.1 bar to about 0.3 bar.

13. The process of claim 12, wherein the pressurized ring has a pressure of from about 0.15 bar to about 0.25 bar.

14. The process of claim 1, wherein up to 100% of toner is reclaimed from the waste toner.

15. The process of claim 14, wherein from about 50% to about 70% of toner is reclaimed from the waste toner.

16. An apparatus for separating toner from a toner/carrier mixture, comprising:

a cyclone separator covering a receiving vessel;

a pressurized ring attached to an inside of the cover;

an annular plenum defined by a tunnel, the tunnel being formed along an inner circumference of the pressurized ring; and a slit formed along an outer circumference of the tunnel, wherein pressurized air from the pressurized ring blows into the annular plenum through the slit to further separate a toner from a toner/carrier mixture such that the toner continues on a flow path along an inner circumferential of the annular plenum and the carrier continues along an outer circumferential of the annular plenum to exit into the receiving vessel.

17. The apparatus of claim 16, wherein the cover further includes an entryway and an exitway and the exitway is in flow communication with a screening device adapted to screen the toner.

18. The apparatus of claim 17, wherein the toner continues on the flow path along the annular plenum and exits the tunnel directly into the screening device.

19. The apparatus of claim 18, wherein the toner is passed through the annular plenum from about 1 to about 5 times before exiting into the screening device.

20. The apparatus of claim 16, wherein the slit runs in a horizontal direction and has a width of from about 0.1 mm to about 0.3 mm.

21. The apparatus of claim 20, wherein the slit has a width of from 0.2 mm to about 0.25 mm.

22. The apparatus of claim 16, wherein the slit further comprises a plurality of vertical slits forming a grating over an entire circumference of the pressurized ring.

23. The apparatus of claim 16 being adapted to reclaim up to 100% toner from the toner/carrier mixture.

24. The apparatus of claim 23 being adapted to reclaim from about 50% to about 70% toner from the toner/carrier mixture.

25. The apparatus of claim 16, wherein the toner/carrier mixture has a toner to carrier ratio of from about 15:1 to about 1:2.

26. An apparatus for separating toner from a toner/carrier mixture, comprising:

a cyclone separator covering a receiving vessel;

a pressurized ring attached to an inside of the cover;

an annular plenum defined by a tunnel, the tunnel being formed along an inner circumference of the pressurized ring; and a slit formed along an outer circumference of the tunnel, the slit having a width of from about 0.1 mm to about 0.3 mm, wherein the cover further includes an entryway and an exitway and the exitway is in flow communication with a screening device adapted to screen toner, and wherein pressurized air from the pressurized ring blows into the annular plenum through the slit to further separate a toner from a toner/carrier mixture such that the toner continues on a flow path along an inner circumferential of the annular plenum and the carrier continues along an outer circumferential of the annular plenum to exit into the receiving vessel.

* * * * *